US012660926B2

(12) United States Patent
Pao

(10) Patent No.: US 12,660,926 B2
(45) Date of Patent: Jun. 23, 2026

(54) FOLDABLE DEVICE

(71) Applicant: STEP2GOLD CO., LTD., Taichung City (TW)

(72) Inventor: Chih-Ting Pao, Taichung City (TW)

(73) Assignee: STEP2GOLD CO., LTD., Taichung City (TW)

( * ) Notice: Subject to any disclaimer, the term of this patent is extended or adjusted under 35 U.S.C. 154(b) by 119 days.

(21) Appl. No.: 18/924,394

(22) Filed: Oct. 23, 2024

(65) Prior Publication Data

US 2025/0143466 A1 May 8, 2025

(30) Foreign Application Priority Data

Nov. 2, 2023 (TW) ..... 112142246

(51) Int. Cl.
*A47C 4/28* (2006.01)

(52) U.S. Cl.
CPC ..... *A47C 4/286* (2013.01)

(58) Field of Classification Search
CPC ..... A47C 4/286
See application file for complete search history.

*Primary Examiner* — Jonathan Liu
(74) *Attorney, Agent, or Firm* — Burris Law, PLLC

(57) ABSTRACT

A foldable device includes a pivot seat, at least one leg rod unit including a leg rod that extends through the pivot seat, and a limiting member that is mounted to the leg rod, at least one connecting member pivoted to the leg rod and having a connecting segment, and a pivot unit including at least one biasing member. When the at least one connecting member is substantially collinear with the leg rod, the at least one connecting member is, under exertion of an external force, movable relative to the leg rod to a limiting position. When the external force is released, the at least one connecting member is biased by a resilient force of the at least one biasing member to move relative to the leg rod from the limiting position to a releasing position.

6 Claims, 9 Drawing Sheets

FOLDABLE DEVICE

CROSS-REFERENCE TO RELATED APPLICATION

This application claims priority to Taiwanese Invention Patent Application No. 112142246, filed on Nov. 2, 2023, the entire disclosure of which is incorporated by reference herein.

FIELD

The disclosure relates to a foldable device, and more particularly to a foldable device that is foldable in a pivotable manner.

BACKGROUND

A conventional tripod chair includes three leg rods that are rotatable relative to each other, and a fabric member. The fabric member is disposed on a top end of each of the leg rods, and the leg rods are rotatable between a closed position and an opened position. When the leg rods are in the closed position, the top ends of the leg rods are relatively proximate to each other, and the fabric member is folded so that the conventional tripod chair may be easily stored. When the leg rods are in the opened position, the top ends of the leg rods are relatively distal from each other, so that the fabric member is unfolded and a user is allowed to sit on the conventional tripod chair.

A size of a sitting area on the fabric member is determined by how far apart the top ends of the leg rods are from each other when the leg rods are in the opened position. However, for the sake of portability, the leg rods are not very long, which results in the conventional tripod chair having a small sitting area, thereby causing the user to be uncomfortable when sitting thereon.

SUMMARY

Therefore, an object of the disclosure is to provide a foldable device that can alleviate at least one of the drawbacks of the prior art.

According to the disclosure, the foldable device includes a pivot seat, at least one leg rod unit, at least one connecting member, and a pivot unit. The at least one leg rod unit includes a leg rod and a limiting member. The leg rod extends through the pivot seat, and has an upper segment above the pivot seat. The limiting member has a securing portion mounted to the upper segment, and a limiting portion extending upwardly from the securing portion and cooperating with the upper segment to define a receiving space therebetween. The at least one connecting member has a connecting segment that is pivotally connected to the upper segment of the leg rod of the at least one leg rod unit, and an end segment that is opposite to the connecting segment. The pivot unit includes at least one biasing member that is connected between the upper segment of the leg rod of the at least one leg rod unit and the connecting segment of the at least one connecting member for resiliently biasing the connecting segment away from the upper segment. When the at least one connecting member is pivoted relative to the leg rod of the at least one leg rod unit until the at least one connecting member is substantially collinear with the leg rod and the end segment of the at least one connecting member is away from the leg rod, the at least one connecting member is, under exertion of an external force, movable relative to the leg rod to a limiting position, where the connecting segment of the at least one connecting member engages a bottom end of the receiving space of the at least one leg rod unit such that pivot movement of the at least one connecting member toward the leg rod is blocked by the limiting member of the at least one leg rod unit. When the external force is released, the at least one connecting member is biased by a resilient force of the at least one biasing member to move relative to the leg rod from the limiting position to a releasing position, where the connecting segment is disengaged from the bottom end of the receiving space such that the pivot movement of the at least one connecting member toward the leg rod is permitted.

BRIEF DESCRIPTION OF THE DRAWINGS

Other features and advantages of the disclosure will become apparent in the following detailed description of the embodiment(s) with reference to the accompanying drawings. It is noted that various features may not be drawn to scale.

DETAILED DESCRIPTION

Figure 1:
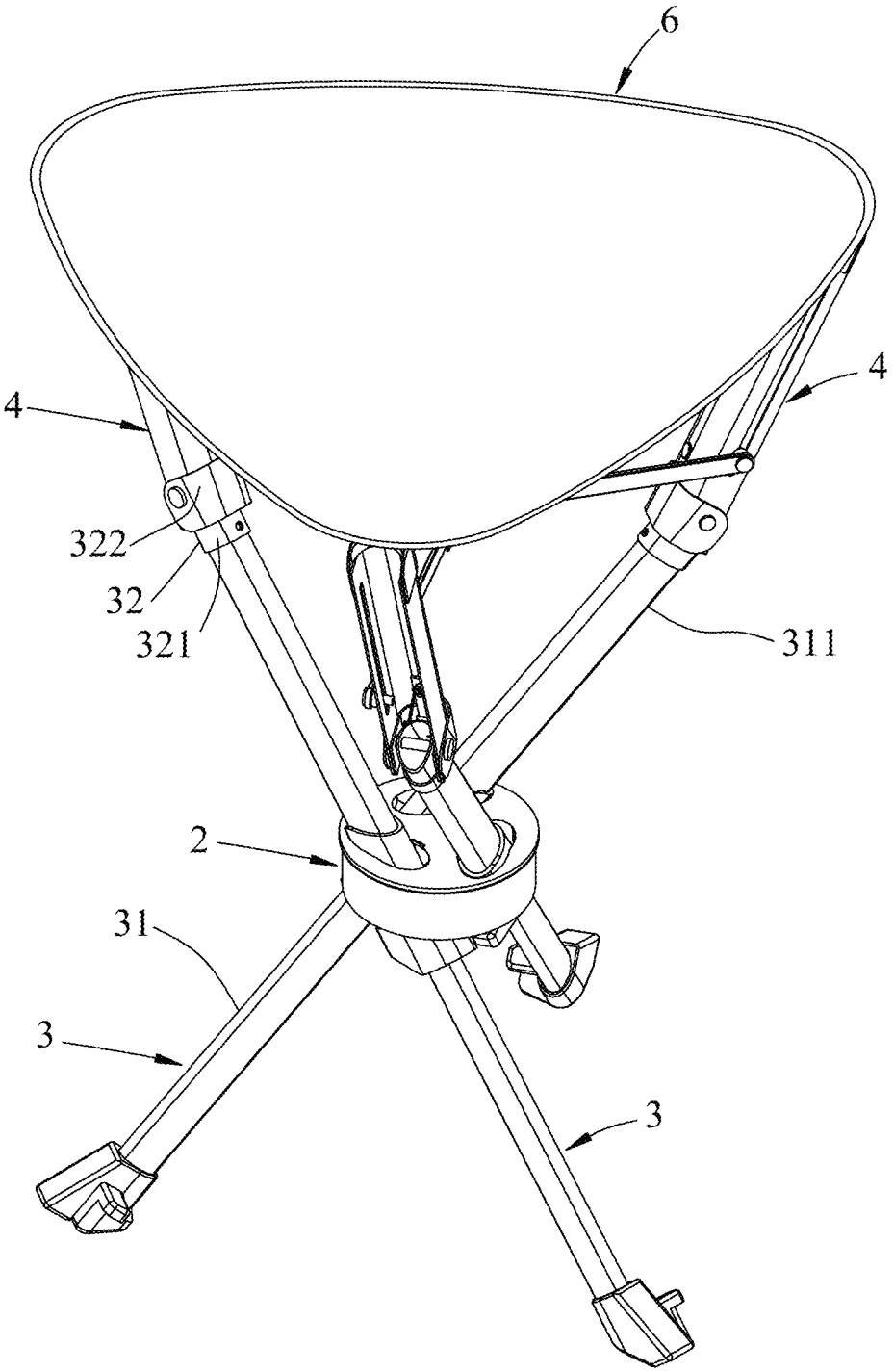
FIG. 1 is a perspective view illustrating an embodiment of a foldable device according to the disclosure.

Before the disclosure is described in greater detail, it should be noted that where considered appropriate, reference numerals or terminal portions of reference numerals have been repeated among the figures to indicate corresponding or analogous elements, which may optionally have similar characteristics.

It should be noted herein that for clarity of description, spatially relative terms such as "top," "bottom," "upper," "lower," "on," "above," "over," "downwardly," "upwardly" and the like may be used throughout the disclosure while making reference to the features as illustrated in the drawings. The features may be oriented differently (e.g., rotated 90 degrees or at other orientations) and the spatially relative terms used herein may be interpreted accordingly.

Figure 2:
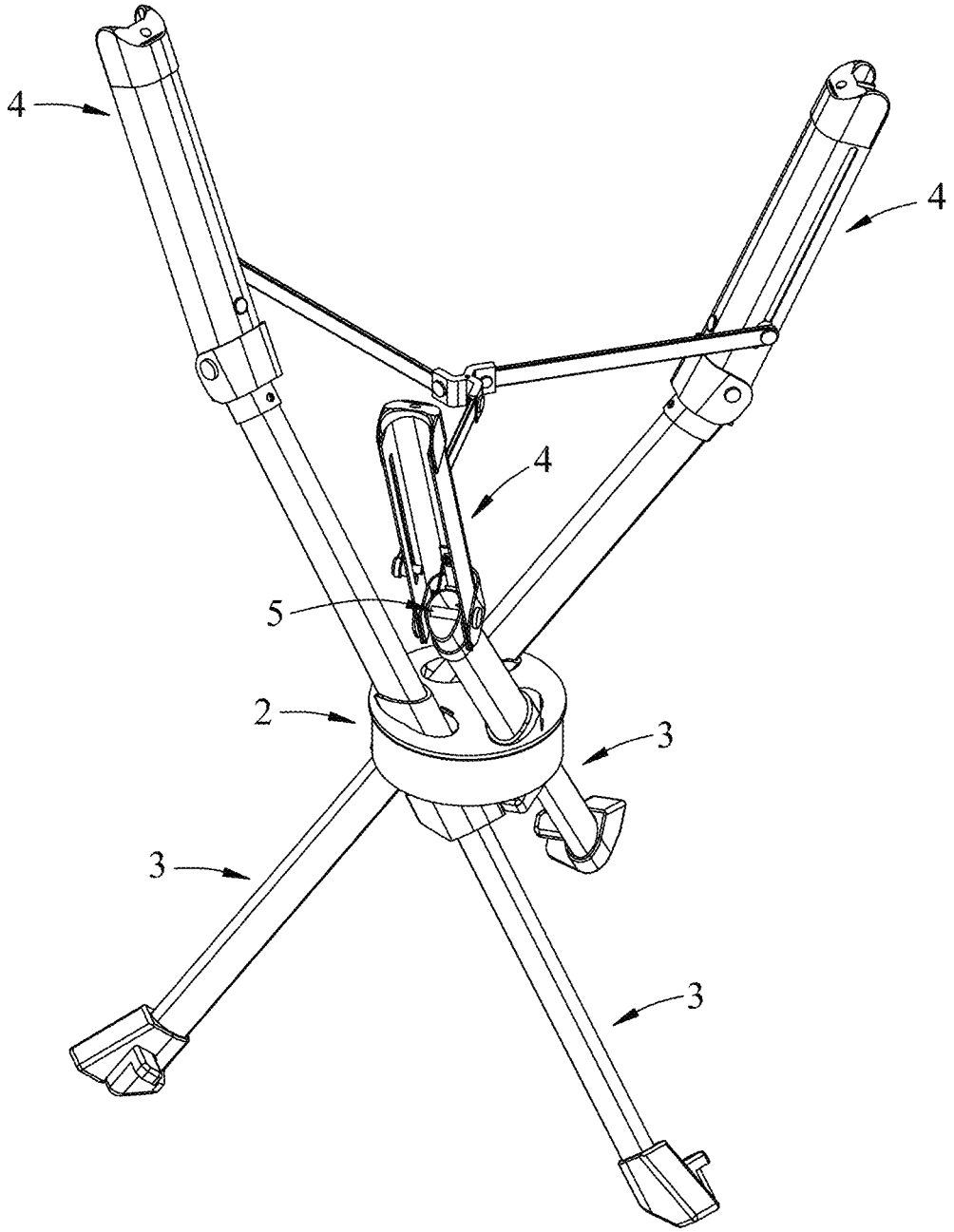
FIG. 2 is a fragmentary perspective view of the embodiment.
Figure 3:
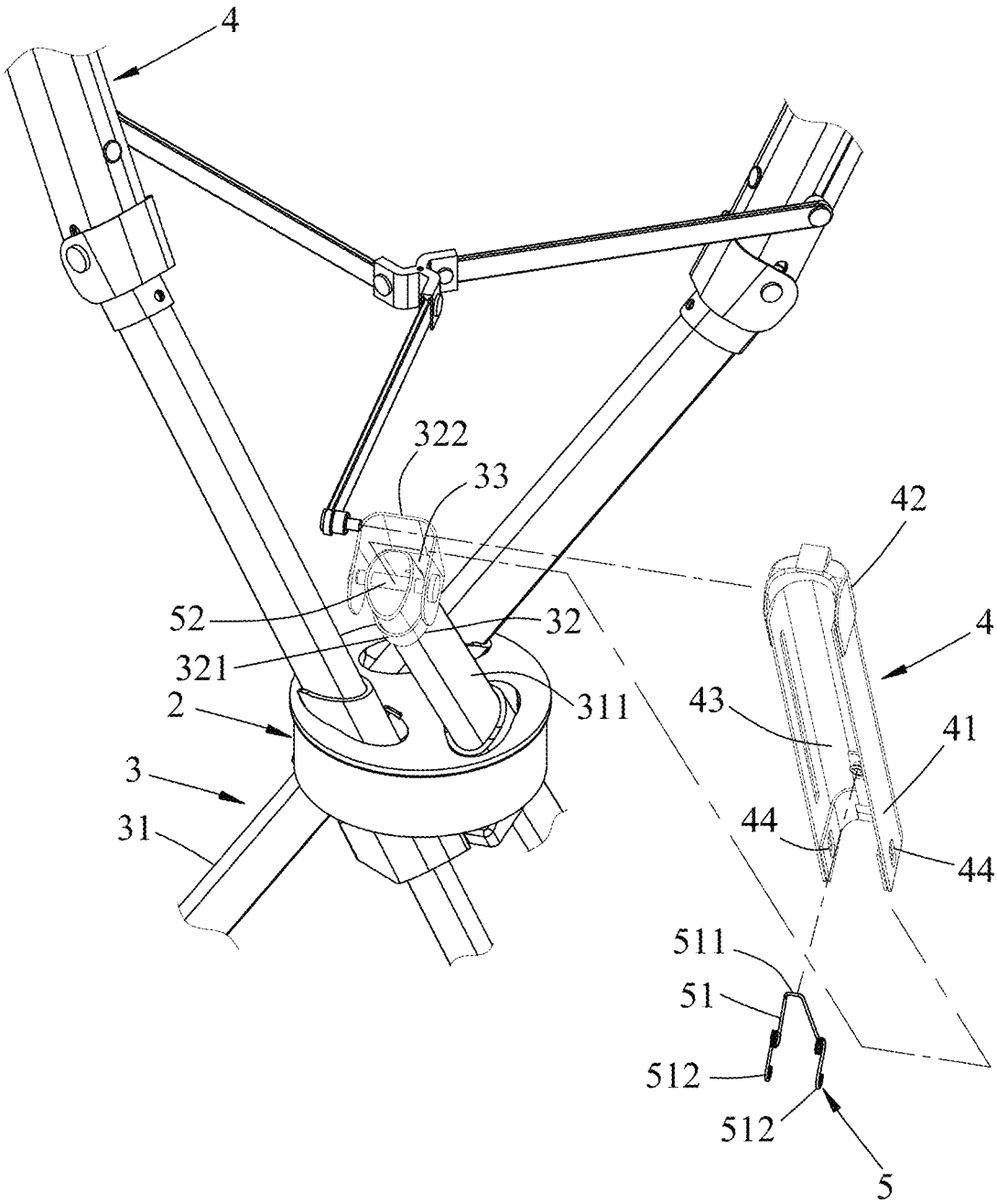
FIG. 3 is a fragmentary and partially exploded perspective view of the embodiment.

Referring to FIGS. 1 to 3, an embodiment of a foldable device according to the disclosure includes a pivot seat 2, at least one leg rod unit 3, at least one connecting member 4, a pivot unit 5, and a fabric member 6. In this embodiment, the at least one leg rod unit 3 includes three leg rod units 3, and the at least one connecting member 4 includes three connecting members 4.

Each of the leg rod units 3 includes a leg rod 31 that extends through the pivot seat 2, and that has an upper segment 311 above the pivot seat 2, and a limiting member 32 that is mounted to the leg rod 31.

The limiting member 32 has a securing portion 321 mounted to the upper segment 311, and a limiting portion 322 extending upwardly from the securing portion 321. The limiting portion 322 cooperates with the upper segment 311 to define a receiving space 33 therebetween, and the receiving space 33 opens upwardly.

Figure 4:
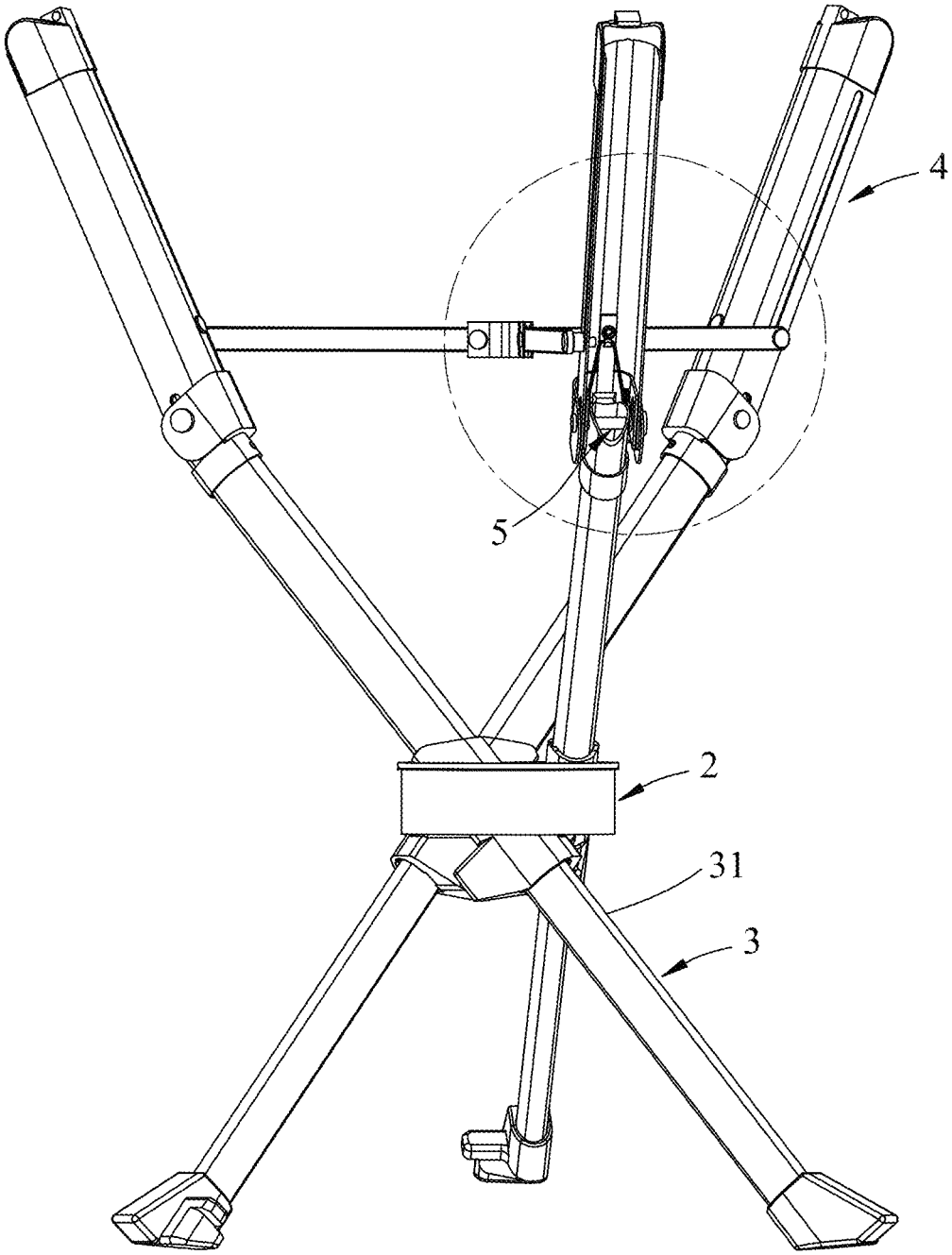
FIG. 4 is a fragmentary perspective view similar to FIG. 2, but is viewed from a different angle.

Referring to FIGS. 1, 3 and 4, the connecting members 4 are respectively connected to the leg rods 31 of the leg rod units 3. Specifically, each of the connecting members 4 has a connecting segment 41 that is pivotally connected to the upper segment 311 of the leg rod 31 of the respective one of the leg rod units 3, an end segment 42 that is opposite to the connecting segment 41, an intermediate segment 43 that is disposed between the connecting segment 41 and the end segment 42, and two guide grooves 44 that are formed in the connecting segment 41 and that are elongated in a direction parallel to a longitudinal axis of the connecting member 4.

The pivot unit 5 is mounted to the leg rods 31, and is connected to the connecting members 4. Specifically, the pivot unit 5 includes at least one biasing member 51, and three pivot shafts 52 (only one is visible in FIG. 3) that are connected respectively to the leg rods 31 of the leg rod units 3. In this embodiment, the at least one biasing member 51 includes three biasing members 51, and each of the biasing members 51 is connected to the intermediate segment 43 of a respective one of the connecting members 4. Each of the pivot shafts 52 engages the guide grooves 44 of a respective one of the connecting members 4, and extends through the upper segment 311 of the leg rod 31 of a respective one of the leg rod units 3. The pivot shafts 52 are respectively connected to the biasing members 51.

Each of the biasing members 51 is connected between the upper segment 311 of the leg rod 31 of a respective one of the leg rod units 3 and the connecting segment 41 of the respective one of the connecting members 4 for resiliently biasing the connecting segment 41 away from the upper segment 311. Each of the biasing members 51 has an intermediate portion 511 connected to the intermediate segment 43 of the respective one of the connecting members 4, and two coupling portions 512 extending respectively and downwardly from opposite ends of the biasing member 51, and connected respectively to opposite end portions of the respective one of the pivot shafts 52. In this embodiment, each of the biasing members 51 is a spring. The coupling portions 512 of each of the biasing members 51 are disposed respectively at opposite outer sides of the upper segment 311 of the leg rod 31 of the respective one of the leg rod units 3. Each of the pivot shafts 52 extends through the guide grooves 44 of the respective one of the connecting members 4, such that each of the connecting members 4 is pivotable relative to the leg rod 31 of the respective one of the leg rod units 3.

The fabric member 6 is connected to the end segments 42 of the connecting members 4.

When the foldable device is in use, each of the connecting members 4 may be respectively pivoted relative to the leg rod 31 of the respective one of the leg rod units 3.

For the sake of brevity, only one leg rod unit 3, one connecting member 4, one biasing member 51 and one pivot shaft 52 will be described in the following unless stated otherwise.

Figure 5:
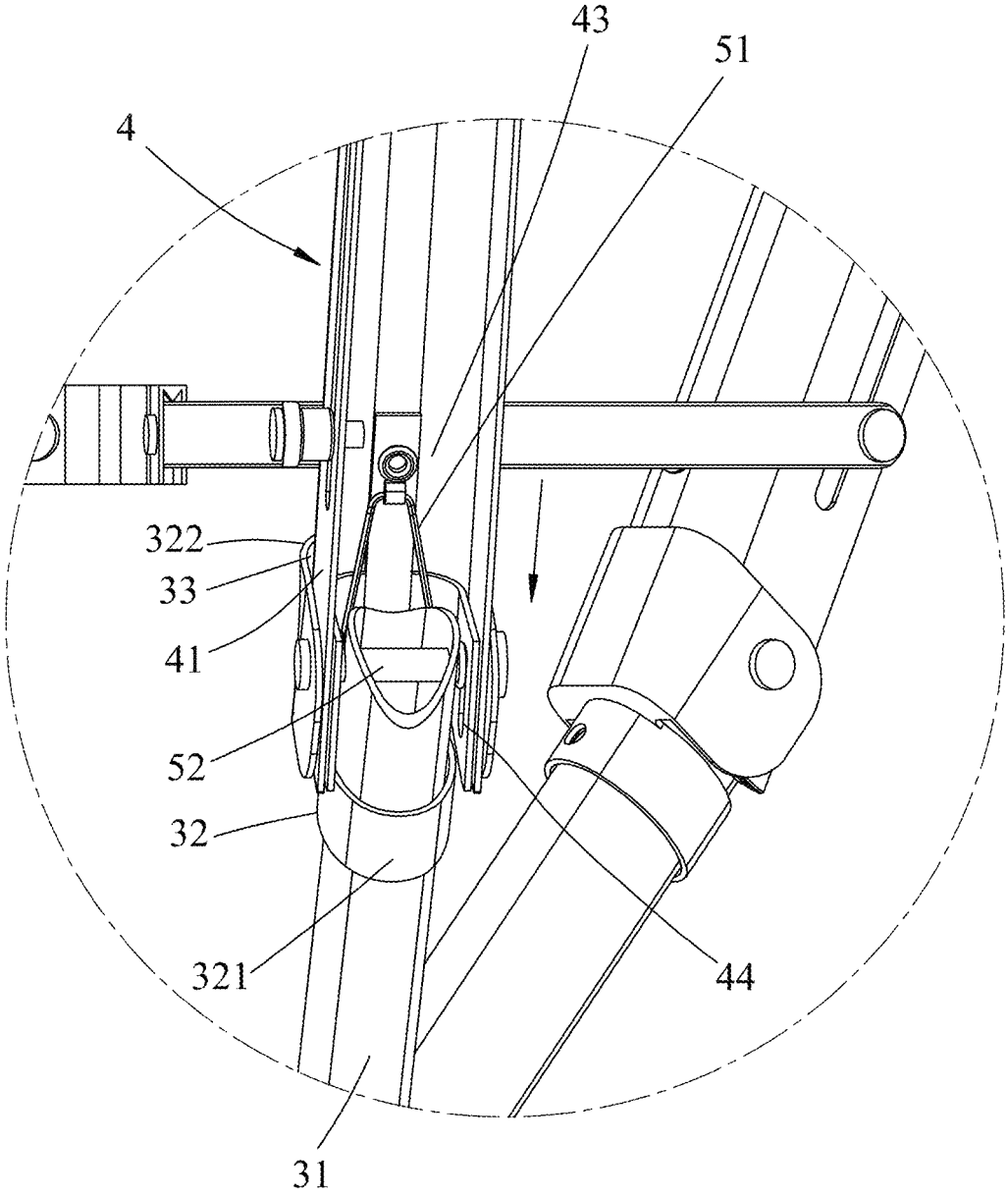
FIG. 5 is a partially enlarged perspective view of FIG. 4, illustrating a connecting member in a limiting position relative to a leg rod.
Figure 6:
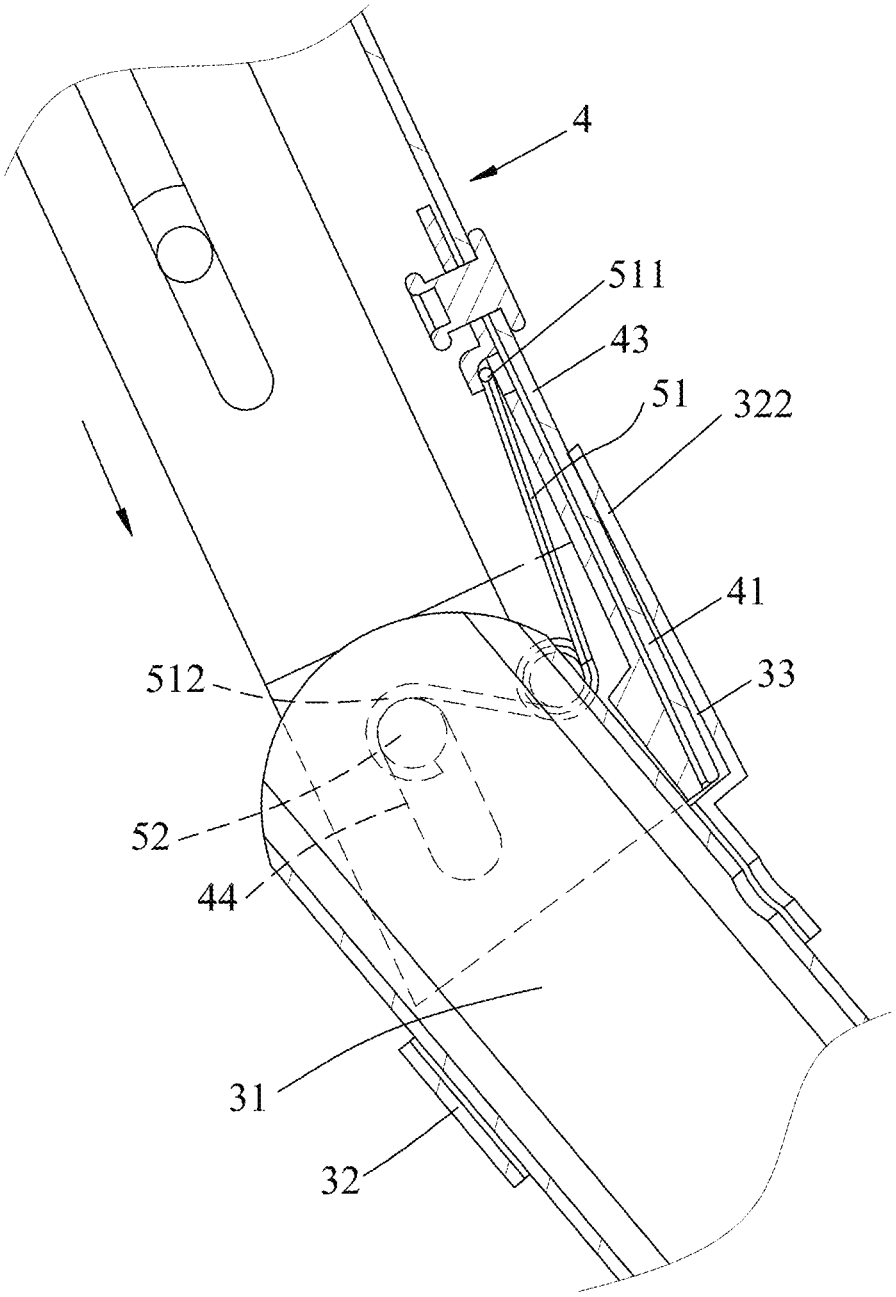
FIG. 6 is a fragmentary sectional view illustrating the connecting member in the limiting position relative to the leg rod.

Referring to FIGS. 3, 5 and 6, when the connecting member 4 is pivoted relative to the leg rod 31 until the connecting member 4 is substantially collinear with the leg rod 31 and the end segment 42 of the connecting member 4 is away from the leg rod 31, the connecting member 4 is, under exertion of a downward external force, movable relative to the leg rod 31 against a resilient force of the biasing member 51 to a limiting position, where the connecting segment 41 of the connecting member 4 engages a bottom end of the receiving space 33 of the leg rod unit 3 such that pivot movement of the connecting member 4 toward the leg rod 31 is blocked by the limiting portion 322 of the limiting member 32 of the leg rod unit 3 and the upper segment 311 of the leg rod 31, and where the pivot shaft 52 abuts against top ends of the guide grooves 44.

Figure 7:
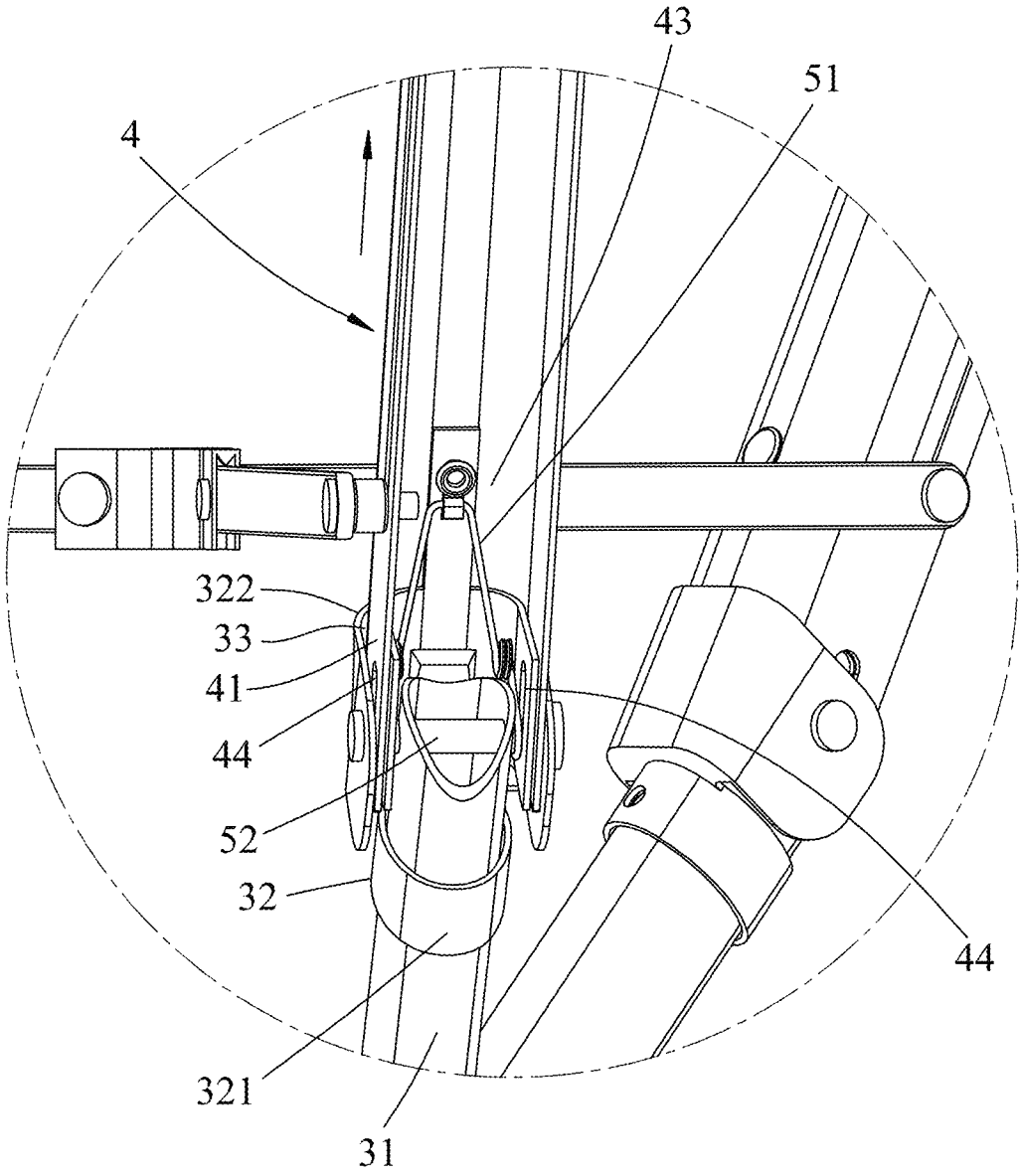
FIG. 7 is an enlarged perspective view similar to FIG. 5, but illustrates the connecting member in a releasing position relative to the leg rod.
Figure 8:
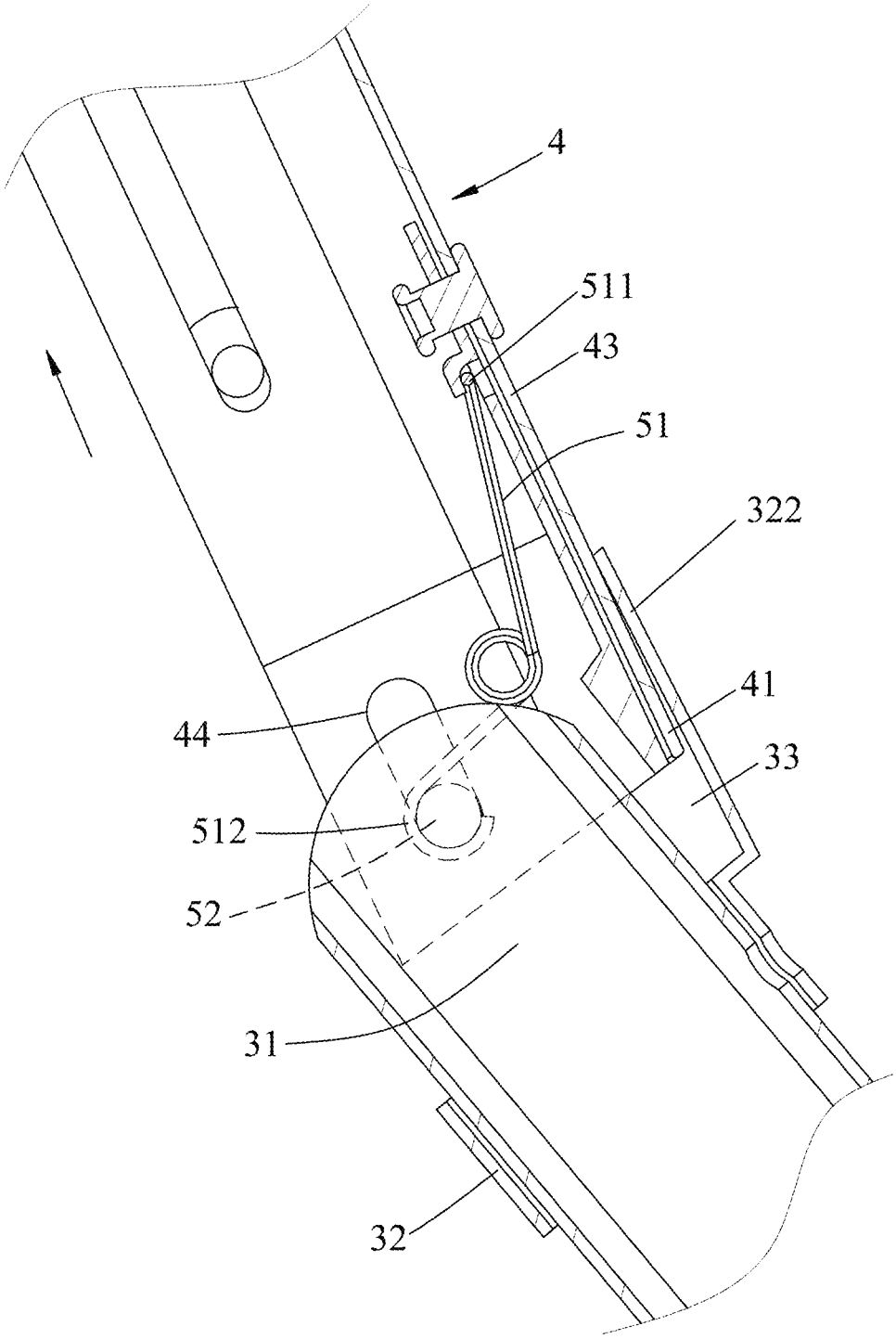
FIG. 8 is a fragmentary sectional view similar to FIG. 6, but illustrates the connecting member in the releasing position relative to the leg rod.
Figure 9:
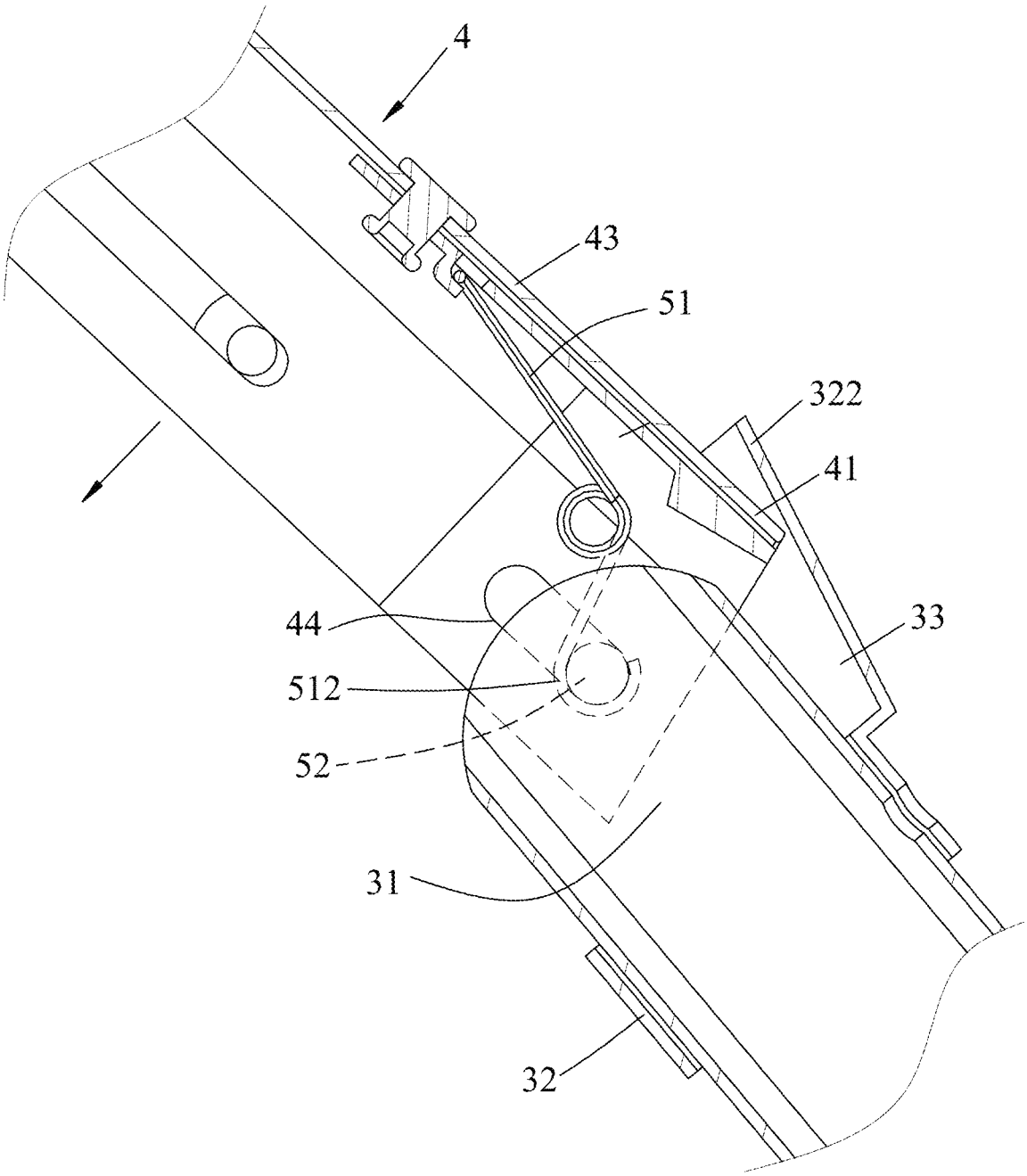
FIG. 9 is a fragmentary sectional view similar to FIG. 8, but illustrates the connecting member between the limiting position and the releasing position.

Referring to FIGS. 3, 7 and 8, when the downward external force is released, the connecting member 4 is biased by the resilient force of the biasing member 51 to move relative to the leg rod 31 from the limiting position to a releasing position, where the pivot shaft 52 abuts against bottom ends of the guide grooves 44, and the connecting segment 41 is disengaged from the bottom end of the receiving space 33 such that the pivot movement of the connecting member 4 toward the leg rod 31 is no longer blocked by the limiting member 32 of the leg rod unit 3, and that the pivot movement of the connecting member 4 toward the leg rod 31 is permitted, as illustrated in FIG. 9.

Referring to FIGS. 1 and 3, when the foldable device is unfolded, the end segments 42 of the connecting members 4 are away from one another, and the fabric member 6 is unfolded by the connecting members 4. As such, the foldable device of the disclosure has a larger sitting area compared to a folding device that is not equipped with the connecting members and has a fabric member directly connected to leg rod(s) instead of end segments of connecting members, which makes the user more comfortable when they sit on the foldable device.

Referring to FIGS. 1, 3 and 6, when the user sits on the fabric member 6, the weight of the user is exerted onto the fabric member 6 and the connecting members 4, and each of the connecting members 4 is moved to the limiting position such that pivot movement of each of the connecting members 4 toward the leg rod 31 is blocked by the limiting portion 322 of the limiting member 32 of the respective one of the leg rod units 3, thereby ensuring structural stability and steadiness of the foldable device and preventing the foldable device from shaking.

Referring to FIGS. 1, 3 and 8, when the user stands up and is no longer sitting on the fabric member 6, the fabric member 6 and the connecting members 4 are no longer affected by the weight of the user, and each of the connecting members 4 is biased by the respective one of the biasing members 51 to move relative to the leg rod 31 of the respective one of the leg rod units 3 to the releasing position. At this time, each of the connecting members 4 is no longer blocked by the limiting portion 322 of the limiting member 32 of the respective one of the leg rod units 3 and may be pivoted so that the foldable device may be folded.

It should be noted that, the numbers of the leg rod units 3, the connecting members 4, and the biasing members 51 are not limited to the numbers thereof in this embodiment, and may be adjusted as needed in other embodiments. When the number of the connecting members 4 is one or two, the numbers of the leg rod units 3 and the biasing members 51 may be adjusted correspondingly to achieve the same effects the leg rod units 3, the connecting members 4, and the biasing members 51 have in this embodiment.

In conclusion, by virtue of the configuration of the leg rods 31, the limiting members 32, the connecting members 4, and the biasing members 51, the connecting members 4 can be pivoted relative to the leg rods 31 of the leg rod units 3 and move between the limiting position and the releasing position, and the foldable device can remain steady when the connecting members 4 are moved by the downward external force to the limiting position. Hence, the objective of the disclosure is achieved.

In the description above, for the purposes of explanation, numerous specific details have been set forth in order to provide a thorough understanding of the embodiment(s). It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects; such does not mean that every one of these features needs to be practiced with the presence of all the other features. In other words, in any described embodiment, when implementation of one or more features or specific details does not affect implementation of another one or more features or specific details, said one or more features may be singled out and practiced alone without said another one or more features or specific details. It should be further noted that one or more features or specific details from one embodiment may be practiced together with one or more features or specific details from another embodiment, where appropriate, in the practice of the disclosure.

While the disclosure has been described in connection with what is (are) considered the exemplary embodiment(s), it is understood that this disclosure is not limited to the disclosed embodiment(s) but is intended to cover various arrangements included within the spirit and scope of the broadest interpretation so as to encompass all such modifications and equivalent arrangements.

What is claimed is:

1. A foldable device comprising:

a pivot seat;

at least one leg rod unit including a leg rod that extends through said pivot seat, and that has an upper segment above said pivot seat, and a limiting member that has a securing portion mounted to said upper segment, and a limiting portion extending upwardly from said securing portion and cooperating with said upper segment to define a receiving space therebetween;

at least one connecting member having a connecting segment that is pivotally connected to said upper segment of said leg rod of said at least one leg rod unit, and an end segment that is opposite to said connecting segment; and a pivot unit including at least one biasing member that is connected between said upper segment of said leg rod of said at least one leg rod unit and said connecting segment of said at least one connecting member for resiliently biasing said connecting segment away from said upper segment;

wherein, when said at least one connecting member is pivoted relative to said leg rod of said at least one leg rod unit until said at least one connecting member is substantially collinear with said leg rod and said end segment of said at least one connecting member is away from said leg rod, said at least one connecting member is, under exertion of an external force, movable relative to said leg rod to a limiting position, where said connecting segment of said at least one connecting member engages a bottom end of said receiving space of said at least one leg rod unit such that pivot movement of said at least one connecting member toward said leg rod is blocked by said limiting member of said at least one leg rod unit; and wherein, when the external force is released, said at least one connecting member is biased by a resilient force of said at least one biasing member to move relative to said leg rod from the limiting position to a releasing position, where said connecting segment is disengaged from said bottom end of said receiving space such that the pivot movement of said at least one connecting member toward said leg rod is permitted.

2. The foldable device as claimed in claim 1, wherein:

said at least one leg rod unit includes three leg rod units;

said at least one connecting member includes three connecting members; and said at least one biasing member includes three biasing members, each of said biasing members being connected between said upper segment of said leg rod of a respective one of said leg rod units and said connecting segment of a respective one of said connecting members.

3. The foldable device as claimed in claim 2, wherein:

said pivot unit further includes three pivot shafts connected respectively to said leg rods of said leg rod units;

each of said connecting members further has an intermediate segment disposed between said connecting segment and said end segment, and two guide grooves formed in said connecting segment and elongated in a direction parallel to a longitudinal axis of said connecting member; and each of said pivot shafts engages said guide grooves of a respective one of said connecting members, and each of said biasing members is connected to a respective one of said pivot shafts and said intermediate segment of the respective one of said connecting members.

4. The foldable device as claimed in claim 3, wherein, each of said biasing members has an intermediate portion connected to said intermediate segment of the respective one of said connecting members, and two coupling portions extending respectively and downwardly from opposite ends of said biasing member, and connected respectively to opposite end portions of the respective one of said pivot shafts.

5. The foldable device as claimed in claim 4, wherein, each of said pivot shafts extends through said upper segment of said leg rod of the respective one of said leg rod units and said guide grooves of the respective one of said connecting members, and said coupling portions of each of said biasing members are disposed respectively at opposite outer sides of said upper segment of said leg rod of the respective one of said leg rod units.

6. The foldable device as claimed in claim 1, further comprising a fabric member connected to said end segment of said at least one connecting member.

* * * * *